US007097117B2

(12) United States Patent
Zur et al.

(10) Patent No.: US 7,097,117 B2
(45) Date of Patent: Aug. 29, 2006

(54) IRRIGATION UNIT SUPPORT STAKE AND SYSTEM

(75) Inventors: Yoel Zur, Korazim (IL); Zohar Katzman, Haifa (IL)

(73) Assignee: Naan-Dan Irrigation System (C.S.) Ltd., Kibbutz Na'an (IL)

( * ) Notice: Subject to any disclaimer, the term of this patent is extended or adjusted under 35 U.S.C. 154(b) by 0 days.

(21) Appl. No.: 10/478,536

(22) PCT Filed: May 15, 2002

(86) PCT No.: PCT/IL02/00378

§ 371 (c)(1),
(2), (4) Date: Nov. 24, 2003

(87) PCT Pub. No.: WO02/094447

PCT Pub. Date: Nov. 28, 2002

(65) Prior Publication Data

US 2004/0149835 A1 Aug. 5, 2004

(30) Foreign Application Priority Data

May 23, 2001 (IL) ..... 143319

(51) Int. Cl.
*A62C 31/22* (2006.01)

(52) U.S. Cl. ..... 239/276; 239/280; 239/390; 239/516; 239/397; 239/275; 248/80; 248/87; 248/88

(58) Field of Classification Search ..... 239/273, 239/276, 280, 280.5, 390, 391, 396, 397, 239/504, 505, 510, 516, 275; 248/87, 88, 248/156, 159, 80; 111/7.1–7.4; 403/326
See application file for complete search history.

(56) References Cited

U.S. PATENT DOCUMENTS

| | | | | | |
|---|---|---|---|---|---|
| 2,212,533 | A | * | 8/1940 | Zimmerman | 239/391 |
| 2,711,927 | A | * | 6/1955 | Miller et al. | 239/276 |
| 2,819,115 | A | * | 1/1958 | Arnold | 239/276 |
| 3,385,525 | A | * | 5/1968 | Jacobs | 239/394 |
| 4,256,262 | A | | 3/1981 | Rosenberg et al. | |
| 4,801,089 | A | | 1/1989 | Zeman | |
| 4,944,476 | A | | 7/1990 | Olson | |
| 4,953,788 | A | * | 9/1990 | Hansen | 239/107 |
| 5,687,909 | A | * | 11/1997 | Dean | 239/276 |

FOREIGN PATENT DOCUMENTS

| | | |
|---|---|---|
| IL | 123907 | 10/2000 |

* cited by examiner

*Primary Examiner*—Dinh Q. Nguyen
(74) *Attorney, Agent, or Firm*—Nath & Associates PLLC; Gregory B. Kang; Teresa M. Arroyo

(57) ABSTRACT

A sprinkler assembly comprising in combination a sprinkler mounting stake and a sprinkler comprising. The sprinkler comprises a sprinkler body formed with a support member receptacle and locking portion. The sprinkler mounting stake comprises a ground insertion portion and a sprinkler support portion. The sprinkler support portion comprises a lateral support member extending parallel to a longitudinal axis of the stake and retention member. The support member is insertable within the support member receptacle and a retention member prevents unintentional disengagement of the sprinkler body from the mounting stake.

15 Claims, 4 Drawing Sheets

IRRIGATION UNIT SUPPORT STAKE AND SYSTEM

FIELD OF THE INVENTION

The present invention is concerned with a stake for an irrigation unit and a sprinkler assembly which comprises in combination an irrigation unit and a support stake on which the irrigation unit is mounted and which stake is designed to be secured into the ground for supporting the irrigation unit.

The term "sprinkler" as used herein in the specification and claims denotes any type of irrigation unit, e.g. a mini sprinkler, a sprinkler, a sprayer, etc.

BACKGROUND OF THE INVENTION

Sprinklers of many types, in particular but not restricted thereto, mini sprinklers and sprayers, are often supported by using a ground stake to which it is known to fix also a supply conduit providing irrigation water to the sprinkler. Typically, such conduits are flexible rubber tubes.

Stakes of the concerned type should be on the one hand cheap and easy to manufacture and assemble and, on the other hand, be sufficiently strong for inserting them into the ground and for supporting a sprinkler thereto with a supply conduit extending to the sprinkler which is often dislocated owing to rough handling or extreme temperature changes between day time and night.

U.S. Pat. No. 4,944,476 discloses a ground stake designed for insertion into the ground and adapted for retaining a flexible irrigation conduit coupled to the sprinkler.

Israel Patent No. 123907 discloses a sprinkler assembly comprising a sprinkler mounting stake formed at an upper portion thereof with a sprinkler body gripping portion fitted with a pair of sprinkler body gripping flanges defining between them a sprinkler body receiving recess and a pair of aligned edges of said flanges equally inclined with respect to a median plane of the gripping portion which gripping portion is adapted for snapping engagement over a body portion of a sprinkler formed with a pair of aligning ribs formed on the body which ribs are symmetrically disposed and equi-angularly inclined with respect to a median plane of the body.

This arrangement requires some significant force for engagement of the mini sprinkler with the sprinkler gripping portion and the same applies for a disengagement process.

It is an object of the present invention to provide a sprinkler assembly comprising in combination a sprinkler and a sprinkler mounting stake whilst ensuring that the sprinkler is effectively attached to the stake whilst retaining a predetermined orientation, i.e. always mounted in the same position over the stake. Further objects of the present invention are to provide a sprinkler mounting stake and a sprinkler for use in conjunction with one another.

SUMMARY OF THE INVENTION

According to a first aspect of the invention there is provided a sprinkler assembly comprising in combination a sprinkler mounting stake and a sprinkler; said sprinkler comprising a sprinkler body formed with a support member receptacle and locking portion; a sprinkler mounting stake comprising a ground insertion portion and an sprinkler support portion, said sprinkler support portion comprises a lateral support member extending parallel to a longitudinal axis of the stake and retention member; whereby said support member is insertable within said support member receptacle and a retention member prevents unintentional disengagement of the sprinkler body from the mounting stake.

According to a second aspect of the invention there is provided a sprinkler comprising a sprinkler body and a water emitting member mounted over said sprinkler body and adapted for emitting water at a direction intersecting a longitudinal axis thereof; said sprinkler body comprising an water inlet port and a support member receptacle attachable to a support member of sprinkler mounting stake; said support member receptacle having an axis extending essentially parallel to said longitudinal axis.

According to a third aspect of the invention there is provided a sprinkler mounting stake comprising a lower ground insertion portion and an upper sprinkler support portion; said sprinkler support portion comprising a lateral projection extending essentially parallel to a longitudinal axis of the stake and fitted for insertion into a corresponding support member receptacle of a sprinkler; and a retention member for releasably engaging a corresponding securing member of the sprinkler.

BRIEF DESCRIPTION OF THE DRAWINGS

For better understanding the invention and to see how it may be carried out in practice, an embodiment of a sprinkler assembly according to the present invention will now be described, by way of a non-limiting example only, with reference to the accompanying drawings, in which.

DETAILED DESCRIPTION OF THE INVENTION

Figure 1:
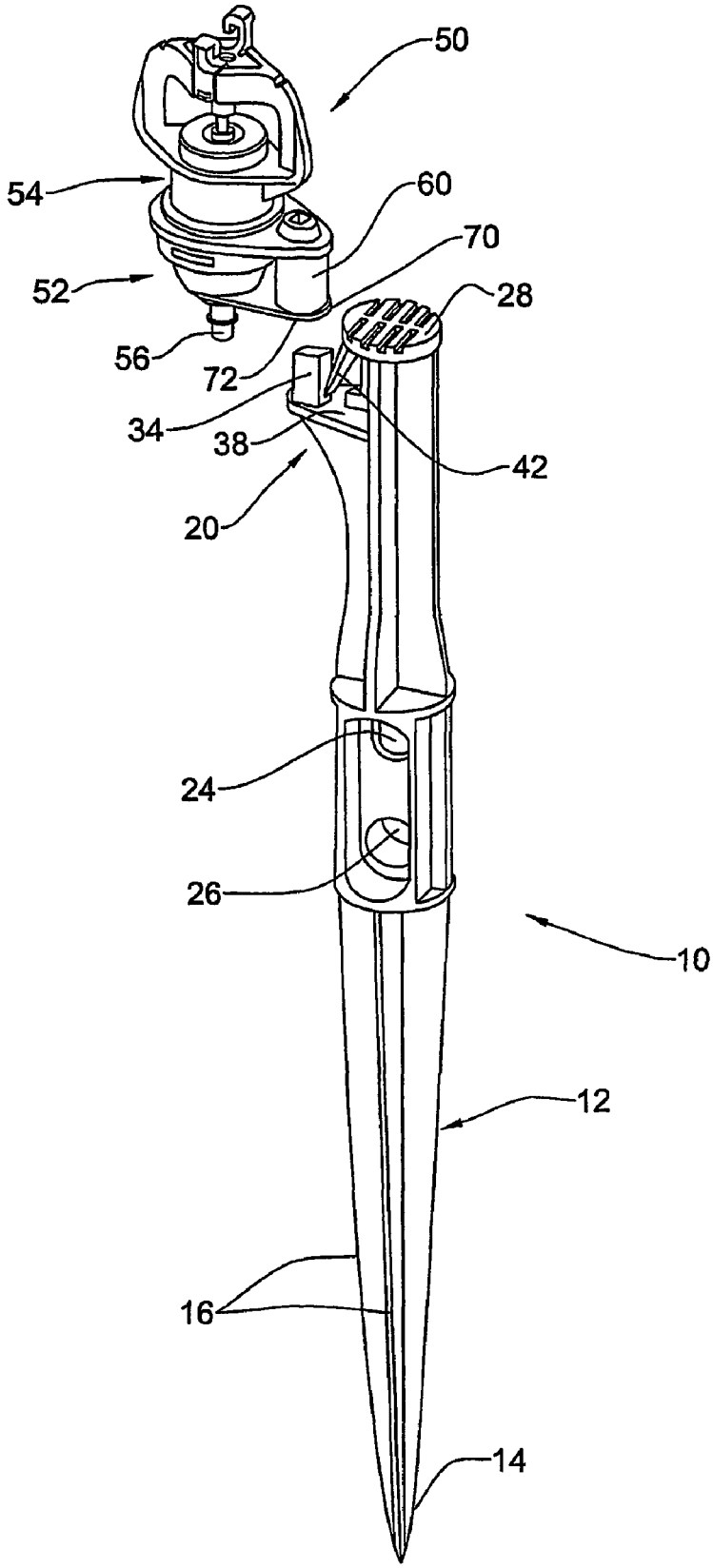
FIG. 1 is a perspective view of a sprinkler and a sprinkler mounting stake in a disconnected position, which when combined, form a sprinkler assembly in accordance with the present invention.
Figure 2:
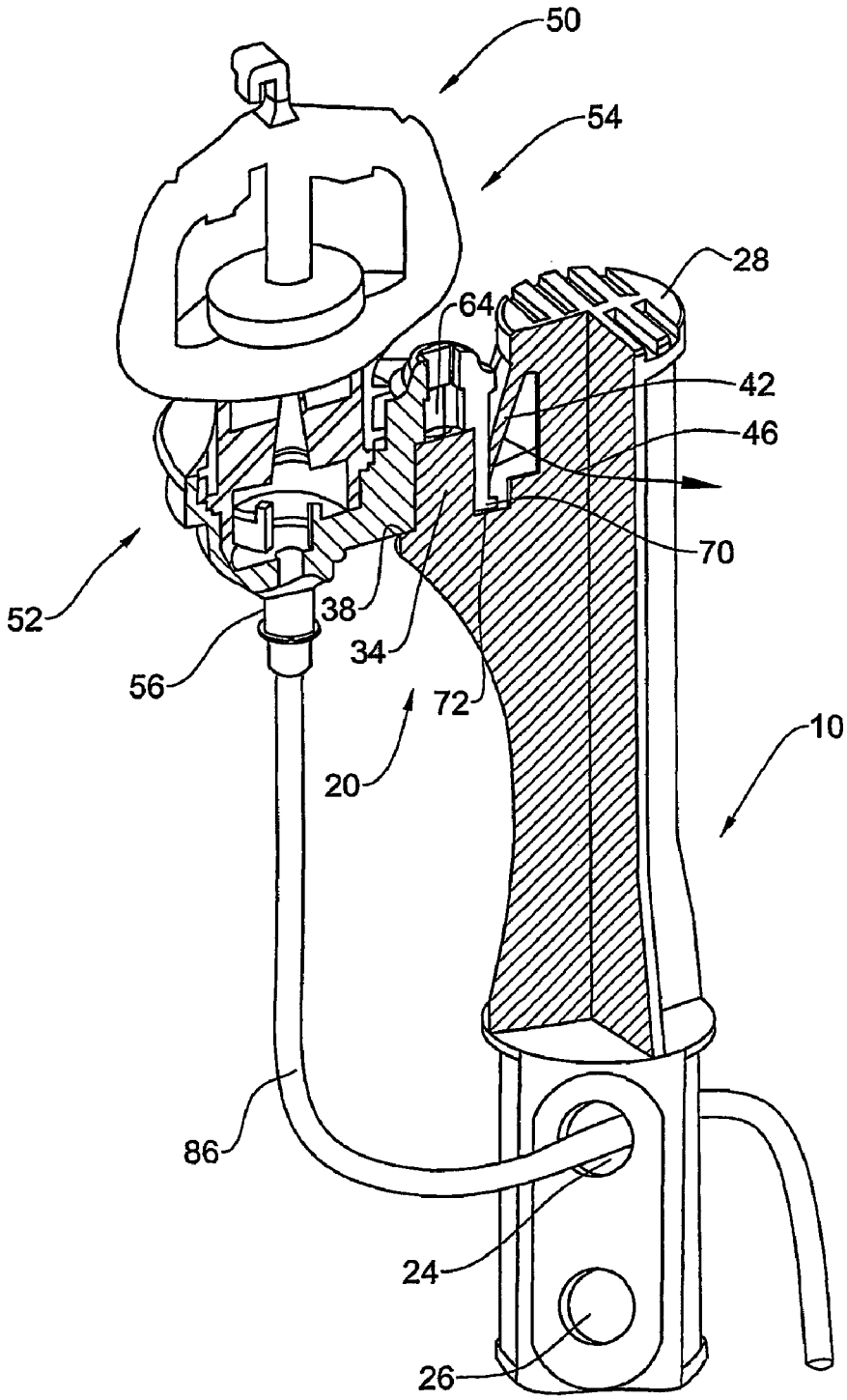
FIG. 2 is a partially sectioned perspective view of a top portion of an assembled sprinkler assembly in accordance with the present invention.

Reference is first made to FIGS. 1 and 2 for familiarizing with the sprinkler assembly and its components. A sprinkler mounting stake generally designated 10 comprises a ground insertion portion 12 having an essentially pointed lower tip 14 and radially extending reinforcement ribs 16. At a top portion of the stake 10 there is a sprinkler support portion generally designated 20 and intermediate the sprinkler support portion 20 and said ground insertion portion 12 there are provided two through going apertures 24 and 26, the purpose of which will be explained hereinafter.

A top end 28 of the mounting stake is a hammering surface which is axially aligned with the body of the stake 10 and is adapted for hammering the stake into hard ground.

Reverting now to the sprinkler support portion 20 there is a lateral support member 34 having an essentially rectangular cross-section, said support member 34 extending essentially parallel to a longitudinal axis of the stake 10. A characterizing feature of the support member 34 is that it has a non-circular cross-section. By one particular design, the support member has a polygonal cross-section and by an other design it has an H-like cross-section.

Figure 3:
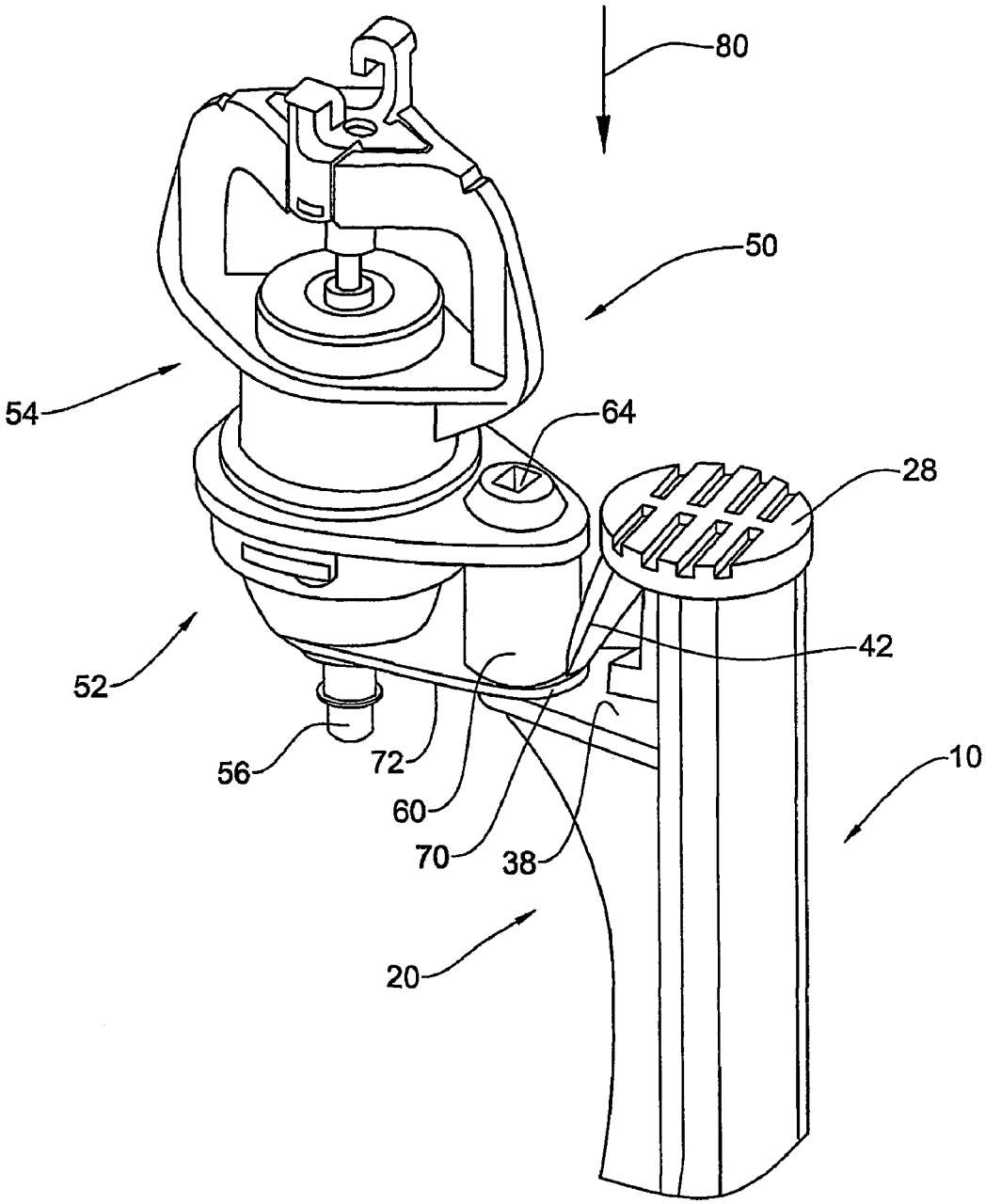
FIG. 3 is a perspective view illustrating how the sprinkler is engaged over a support portion of the sprinkler mounting stake.
Figure 4:
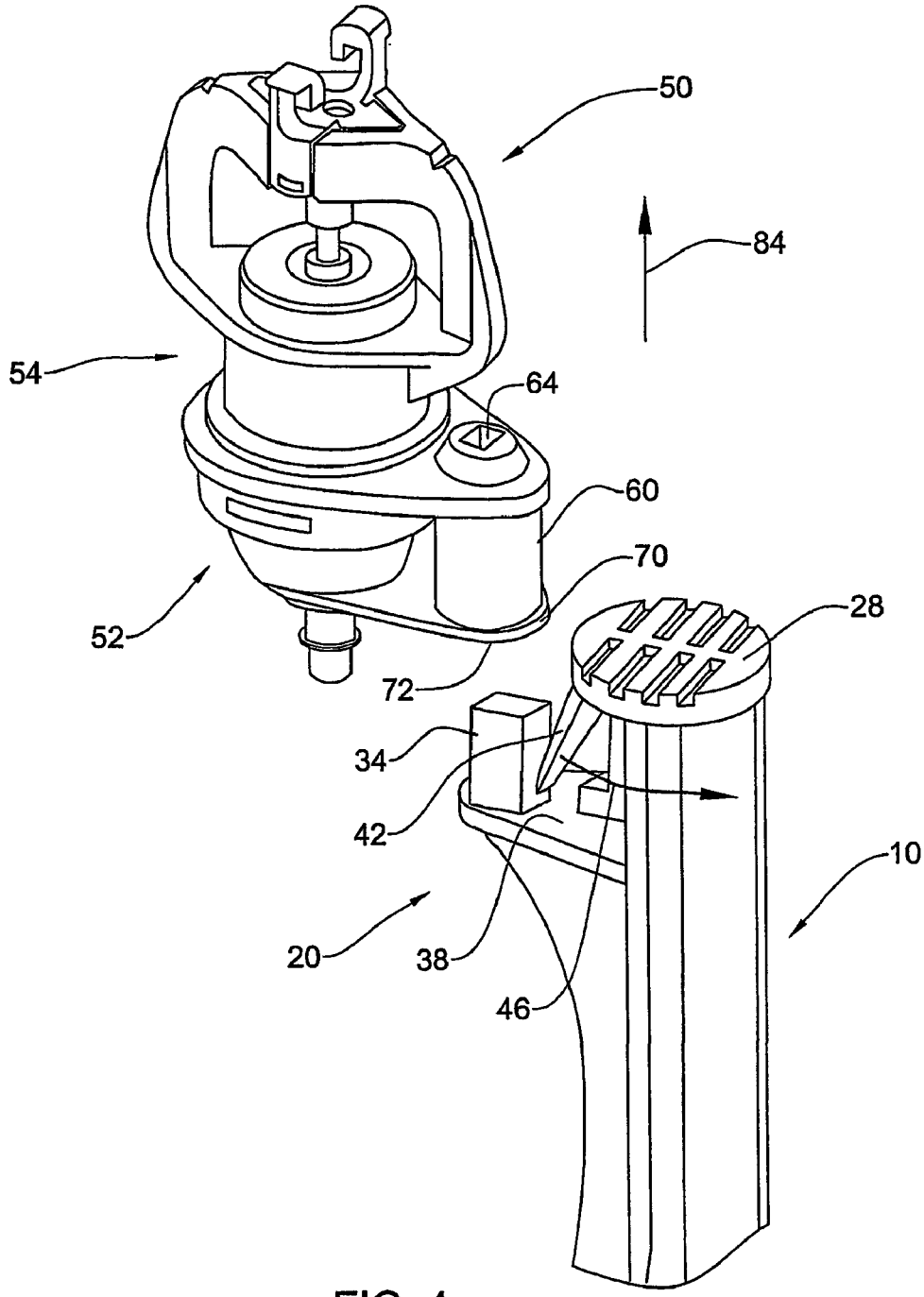
FIG. 4 is a perspective view illustrating how the sprinkler assembly in accordance with the present invention is disengaged.

The support member 34 extends upwardly from a flat surface 38. A retention member 42 is a rigid though pliable (deformable) arm portion integrally formed with the top end of the stake and being deformable by applying manual force thereto, in direction of arrow 46 (FIGS. 2 and 4). As seen in FIGS. 1, 2 and 3, the retention member 42 widens at its lower, free end for easing access therethrough.

Turning now to the sprinkler generally designated 50, it comprises a sprinkler body generally designated 52 and a water emitting member generally designated 54 fitted over said body 52 and adapted for emitting water in a direction intersecting a longitudinal axis of the sprinkler. Whilst the embodiment illustrated in the figure exemplifies a mini sprinkler, it is to be appreciated that any type of irrigation emitting unit may be used, e.g. a sprayer, etc.

Body 52 is formed with a water supply inlet 56 and a support member receptacle 60 formed with a cavity 64, its main portion having a rectangular cross-section corresponding with that of the lateral support member 34 and having at a bottom end thereof a circumferential flanged locking member 70, laterally extending from the support member receptacle 60 and having an essentially flat bottom surface 72.

Turning now to FIG. 3, it is shown how the sprinkler 50 is engaged with the sprinkler support portion 20 of the stake 10, giving rise to constituting the sprinkler assembly in accordance with the present invention. Engagement is obtained merely by engaging the lateral support member 34 within the cavity 64 of the support member receptacle 60 and depressing the sprinkler 50 in the direction of arrow 80 (FIG. 3), resulting in spontaneous momentarily deformation of the retention member 42 whereby the rim of the flanged locking member 70 passes the lower end of the retention member allowing the retention member 42 to snap into its normal position where it engages an upper surface of the flanged locking member 70, preventing the sprinkler 50 from being spontaneously disengaged from the stake 10. In the assembled position the flat bottom surface 72 of the support member receptacle rests over the flat surface 38 of the sprinkler support portion 20.

The arrangement is such that at the engaged position, an attempt to pull out the sprinkler 50 without first disengaging the retention member from the sprinkler, results in that the retention member 42 geometrically locks against the side wall of the support member receptacle 60, namely becomes clamped against the side wall and the flanged locking member 70.

It is appreciated that where the cross-section of the support member 34 is symmetrical, the sprinkler 50 may be mounted on the stake 10 at three positions rotated at 90 ° respective from one another. However, depending on the cross-section of the lateral support member 34 and that of the corresponding receptacle cavity 64, the sprinkler may be disposed over the support member at several positions angularity shifted from one another.

Turning now to FIG. 4 it is illustrated how the sprinkler assembly is disassembled by first disengaging the retention member 42 from its engagement with the rim of the flanged locking member 70 of the sprinkler by deforming said retention member 42, this being carried out by applying force in the direction of arrow 46 where it is now possible to disassemble the sprinkler 50 and pull it upwardly in the direction of arrow 84 (FIG. 4).

Reverting now to the apertures 24 and 26 formed in the intermediate portion of the stake 10, these apertures are adapted for passing therethrough a water supply line 86 (FIG. 2) branching from a main supply line (not shown) whereupon rough handling or movement of the main supply line, the supply line 86 applies essentially axial force on the sprinkler 50. The apertures 24 and 26 are also useful for bending the supply line 86 in a manner (not shown) so as to block the supply conduit when it is desired to temporarily deactivate the associated sprinkler, e.g. for service or for any other purpose.

While the description hereinabove describes a specific embodiment of the invention, it will be understood and appreciated by those skilled in the art that the invention is not limited thereto and that other variations in form and details may be possible, without departing from the scope and spirit of the invention.

For example, rather than providing a rimmed flanged locking member 70 there may be provided a recess in the sprinkler support receptacle for engagement with a bottom edge of the retention member 42. Furthermore, the shape and size of the support member 34 may vary so as to correspond with matching shapes of cavities of the support member receptacle, for example, to indicate different sprinklers, etc.

The invention claimed is:

1. A sprinkler assembly comprising in combination a sprinkler mounting stake and a sprinkler;

said sprinkler comprising a sprinkler body formed with a support member receptacle, which is disposed laterally with respect to the sprinkler body, said sprinkler body is provided with a locking member;

said sprinkler mounting stake comprising a ground insertion portion and a sprinkler support portion, which is laterally extending from the ground insertion portion, said sprinkler support portion comprises a lateral support member protruding from the sprinkler support portion and extending parallel to a longitudinal axis of the sprinkler mounting stake, said sprinkler mounting stake is provided with a retention member;

whereby said lateral support member is insertable within said support member receptacle so as to provide engagement therewith and said retention member is adapted to prevent unintentional disengagement of the support member receptacle from the lateral support member mounting stake.

2. A sprinkler assembly according to claim 1, wherein the support member receptacle is prevented from rotation relatively to the lateral support member.

3. A sprinkler assembly according to claim 2, wherein the lateral support member is a projecting pin having a non-circular cross-section receivable within a correspondingly formed cavity of the support member receptacle.

4. A sprinkler assembly according to claim 3, wherein the sprinkler may be mounted on the sprinkler mounting stake at one or more predetermined fixed positions.

5. A sprinkler assembly according to claim 1, wherein the retention member is a laterally deformable projection displaceable between a first normal position in which it is adapted for engaging a corresponding locking member of the sprinkler body, and a second, deformed position in which it disengages from said locking member thereby allowing the sprinkler to be disengaged from the stake.

6. A sprinkler assembly according to claim 5, wherein the retention member becomes clamped against the locking member upon an attempt to disassemble the sprinkler from the sprinkler mounting stake, without first disengaging the retention member from the locking member.

7. A sprinkler assembly according to claim 5, wherein an attempt to disassemble the sprinkler from the sprinkler mounting stake, without first disengaging the retention member from the locking member results in geometrically locking of the retention member against the locking member.

8. A sprinkler assembly according to claim 5, wherein the locking member of the sprinkler body is a lateral projection engageable withh the retention member, whereby upon engagement the locking member by the retention member the sprinkler becomes axially fixed to the sprinkler mounting stake.

9. A sprinkler assembly according to claim 1, wherein at an assembled state a water emitting portion of the sprinkler extends above an uppermost end of the sprinkler mounting stake.

10. A sprinkler assembly according to claim 1, wherein at an intermediate portion of the stake, below the sprinkler support portion, there is formed at least one aperture through which is adapted to pass a water supply line connectable to a water inlet port of the sprinkler mounted on said sprinkler mounting stake.

11. A sprinkler assembly according to claim 1, wherein at an assembled state the longitudinal axis of the sprinkler mounting stake is parallel to a longitudinal axis of a cavity formed in the support member receptacle, which in turn is parallel to a longitudinal axis of the sprinkler.

12. A sprinkler according to claim 1, wherein the locking member is a lateral flanged member.

13. A sprinkler mounting stake according to claim 1, wherein the retention member is an arm portion, which is integral with a top end of the sprinkler mounting stake and being rigid though pliable so as deform from a normally locking position in which an end thereof is engageable with the locking member of the sprinkler, and a deflected position in which the end of the retention member disengages from the locking member.

14. A sprinkler mounting stake according to claim 1, wherein the said projection has a non-circular cross-section corresponding with cross-section of a cavity formed within the support member receptacle for receiving the projection.

15. A sprinkler mounting stake according to claim 1, wherein the projection has a non-circular cross-section fittable within the support member receptacle of the sprinkler, thereby preventing relative rotational displacement therebetween.

* * * * *